United States Patent [19]

Siegle

[11] 3,951,144

[45] Apr. 20, 1976

[54] MOTOR IGNITION DISTRIBUTION SYSTEM WITH CONTROLLABLE AUXILIARY GAPS

[75] Inventor: Gert Siegle, Hildesheim, Germany

[73] Assignee: Robert Bosch GmbH, Stuttgart, Germany

[22] Filed: Nov. 14, 1974

[21] Appl. No.: 523,866

[30] Foreign Application Priority Data

Nov. 16, 1973 Germany ..... 2357261

[52] U.S. Cl. ..... 123/148 E; 123/148 ND; 200/19 M; 315/209 R; 315/209 M

[51] Int. Cl.[2] ..... H01H 19/00

[58] Field of Search... 123/148 E, 148 ND, 148 DK; 200/19 R, 19 M; 315/209 R, 209 T, 209 M

[56] References Cited

UNITED STATES PATENTS

| | | | |
|---|---|---|---|
| 2,781,412 | 2/1957 | Mike | 200/19 M |
| 3,375,812 | 4/1968 | Koda | 200/19 M |
| 3,556,068 | 1/1971 | Varaut | 123/148 E |
| 3,678,224 | 7/1972 | Takeda | 200/19 M |

FOREIGN PATENTS OR APPLICATIONS

| | | | |
|---|---|---|---|
| 1,477,616 | 4/1967 | France | 200/19 M |
| 884,396 | 12/1961 | United Kingdom | 200/19 M |
| 576,685 | 4/1933 | Germany | 200/19 M |
| 784,559 | 10/1957 | United Kingdom | 200/19 M |

*Primary Examiner*—Charles J. Myhre
*Assistant Examiner*—Paul Devinsky
*Attorney, Agent, or Firm*—William R. Woodward

[57] ABSTRACT

Auxiliary spark gaps with magnetically or electromagnetically controllable gap spacing and gas-filled envelopes are used for distributing ignition pulses to the sparkplugs of a multicylinder internal combustion engine. A moving permanent magnet sequentially reduces the gap width in the firing order in a magnetically operated system. In an electromagnetically operated system, each gap device has a control and a switching circuit operating at low voltage and energizing the coils in turn.

18 Claims, 4 Drawing Figures

MOTOR IGNITION DISTRIBUTION SYSTEM WITH CONTROLLABLE AUXILIARY GAPS

This invention relates to an ignition distribution system for an internal combustion engine having two or more sparkplugs that receive their exciting voltage from the secondary winding of an ignition coil or transformer and, more particularly, a system of the type in which an auxiliary spark gap is connected in series between each of the sparkplugs and the aforesaid secondary winding. The ignition system, of course, serves to ignite a compressed fuel-air mixture in the respective cylinders of the engine.

In a multi-cylinder internal combustion engine in which each cylinder is provided with at least one sparkplug, it is necessary to distribute the ignition voltage pulses in a certain sequence to the sparkplugs of the individual cylinders. A so-called distributor is generally used in which a contact finger is moved past two or more fixed contacts connected to the individual sparkplugs to connect the latter in turn to the secondary winding of the ignition coil and provide a path for the high voltage pulse. At the particular moment at which the fuel-air mixture is to be ignited in a particular cylinder, the contact finger is directly opposite the particular fixed contact related to the sparkplug in the particular cylinder, so that the spark available at this moment as the result of a breakdown between the contact finger and this fixed contact will generate a spark in the selected spark plug to ignite the explosive mixture.

The operation of the flashover distributor just described can easily be disturbed if water condensation with dirt particles or nitrogen oxides generated by electrical sparks come into contact with the inner wall of the distributor and form leakage paths between the fixed contacts, which in known devices can cause energy losses and the danger of a false ignition distribution.

It is an object of the present invention to provide an ignition distribution system of the flashover type in which the difficulties above described can be avoided.

SUBJECT MATTER OF THE PRESENT INVENTION

Briefly, the auxiliary spark gaps between the sparkplugs and the source of ignition pulses are provided in a form in which at least one of the two electrodes of each such device is movable by magnetic force and the selection of the sparkplug which should receive the ignition pulse in each case is accomplished by means for selectively moving the movable electrodes of the respective auxiliary spark gap devices magnetically in sequence in such a way that the gap between the auxiliary spark gap electrodes is narrowed for a period including the moment of application of an ignition voltage pulse by the ignition transformer secondary.

In one form of the invention, the auxiliary spark gap devices are exposed in turn to the magnetic force of a rotatable permanent magnet driven by the engine and the magnetically movable electrodes each have a resilient tongue providing a restoring force and are provided with an attraction member of magnetically conducting material which can be pulled by magnetic force against the restoring force of the resilient tongue to narrow the interelectrode gap. Means for limiting the approach of the electrodes are also provided. At least one of the electrodes is preferably provided with a nose-like projection extending towards the other electrode and the electrodes overlap each other in spaced relation. Preferably, they extend from the region of their neighboring free ends towards their respective points of affixation in generally opposite directions and an enclosing hollow envelope may be provided in the ends of which the electrodes may be fixed. The envelope is preferably filled with an inert gas and at least the surface of the electrode ends is preferably made of a material resistant to disintergration by sputtering of the material under gas ion bombardment.

The means for selectively moving the movable electrodes of the auxiliary spark gap devices may be electromagnetic rather than energized by a permanent magnet and, in this case, energizing coils are provided around the envelopes of the auxiliary spark gap devices, the latter being operated after the manner of a reed switch, although the approach of the electrodes again is limited. In this case, the electrodes themselves are predominantly made of magnetic material and are interposed in the magnetic circuit energized by the control, so that an additional attraction member is not necessary. The energization of the control coil is conveniently accomplished by semiconductor switches excited in turn by a rotary device driven by the engine, so as to cause each coil to be energized with current for a period during which the same transducer causes another semiconductor switch in the primary circuit of the ignition coil to switch into its non-conducting condition and set off an ignition pulse in the circuit of the secondary coil.

The invention is further described by way of example with reference to the accompanying drawings in which.

Figure 1:
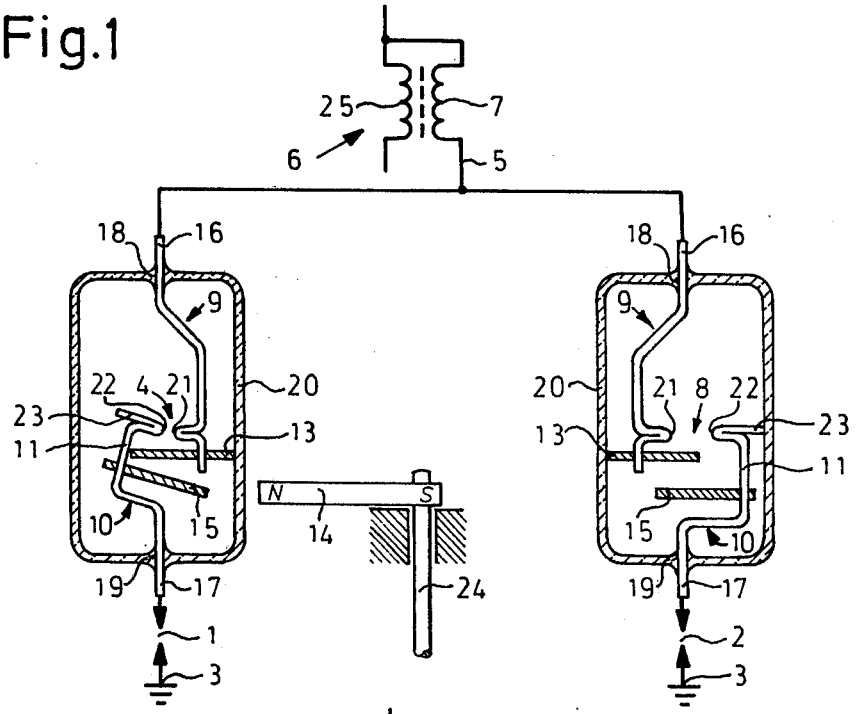
FIG. 1 is a diagram of an ignition distribution system embodying the improvement of this invention, in which the electrode spacing of the auxiliary spark devices is subject to being narrowed by the force of a permanent magnet.

In FIG. 1 there are shown two sparkplugs 1 and 2 each of which is situated in a different cylinder, not shown, of a two-cylinder four-cycle internal combustion engine. The sparkplug 1, as shown in the diagram, has one side provided with a ground connection 3 to the engine head and the other connected through an auxiliary spark gap 4 to the output connection 5 of a secondary winding 7 belonging to the ignition coil (transformer). The sparkplug 2 is likewise provided with a grounded connection 3 on one side and connected on the other side through an input spark gap 8 to the terminal 5 of the secondary winding 7. These sparkplugs 1 and 2 receive ignition voltage from the secondary winding 7 at their respective times of ignition.

Each of the auxiliary spark gaps 4 and 8 are formed between a pair of electrodes 9 and 10 of which one, the electrode 9, is connected to the secondary winding 7 and the other, in each case the electrode 10, is connected to the respective sparkplug, 1 or 2, as the case may be. At least one of the electrodes 9 and 10 forming the respective auxiliary spark gaps 4 and 8, in the illustrated case the respective electrodes 10, is movable by a magnetic force. The selection of the sparkplug which should receive ignition voltage during a particular portion of the complete engine cycle is accomplished by causing the auxiliary spark gap standing in series with the particular sparkplug to have its gap width narrowed for a period including the moment at which the ignition voltage is generated. This operation can be performed in a simple manner by constituting the aforesaid movable electrode, the electrode 10 in the illustrated case, in a form in which it has a resilient tongue portion 11, which may be of rectangular or rounded cross-section, so that it may be attracted by magnetic force to a position nearer to the other electrode, the electrode 9 in the illustrated case, against the spring restoring force of the resilient tongue portion 11.

The potential value at which the auxiliary spark gaps 4 and 8 should break down can be fixed with sufficient accuracy by limiting the spacing to which these spark gaps are narrowed by the movement of their movable electrode or electrodes. In the illustrated case, such limiting is provided by affixing a spacer 13 of insulating material to the electrode 9, against which the electrode 10 butts when moved by an attracting magnetic force. In the illustrated case, the spacer 13 serves at the same time for support of the quiescent electrode 9 in order to hold the electrode 9 in a fixed position.

In order that the magnetic force necessary for electrode movement should not have to be too great, it is desirable to provide an attraction body or armature 15 mounted on the movable electrode 10 between it and the position occupied by the magnet 14 when it moves this particular electrode. The attraction body 15 can be made of a magnetically conducting material such as soft iron or it can, instead, be a permanent magnet. In the latter case, the magnet 14 and the attraction body 15 must approach each other with poles of opposed polarity. In the illustrated preferred construction, the attraction body 15 is a separate member firmly affixed, as by a pressfit, to the electrode 10, so that the electrode 10 itself is not required to be made of a ferromagnetic material.

In order to avoid so far as possible the development of sneak circuits by leakage paths in the auxiliary gap devices, the terminal 16 of the electrode 9 should be located as far as possible from the terminal 17 of the electrode 10. This can be readily provided by disposing these electrodes so that from their neighboring free ends towards their respective points of mounting 18 and 19, they are directed in at least approximately opposed directions. In the illustrated preferred form of construction, the mounting points 18 and 19 of the respective electrodes 9 and 10 are formed by a melted-on seal through a hollow envelope 20 of a non-magnetic and electrically insulating material, preferrably glass or ceramic. In the illustrated case, each of the auxiliary gaps is thus enclosed by a hollow envelope 20. In suitable cases, of course, the several auxiliary spark gaps such as the spark gaps 4 and 8, can be collectively enclosed in a single such hollow envelope.

In the illustrated construction, it is found practical to arrange the electrodes 9 and 10 of each auxiliary spark gap device so that they overlap in spaced relation in the region of their free ends. Furthermore, in the region of these free ends, each of the electrodes is provided with a projection 21,22 extending towards the opposite electrode and formed, more or less, in nose shape. If necessary, only one of the electrodes 9 and 10 can be provided with such a projection. In the illustrated case, these projections 21 and 22 are formed by laterally bentout portions of the respective electrodes 9 and 10. The bent-back end portion 23 of the projection 22 of the movable electrode 10 can be extended sufficiently, as shown in FIG. 1, to support the electrode 10 in its rest position against the envelope 20.

In order to obtain an electric breakdown reliably without excessively high voltages, the envelope 20 is filled with a suitable gas. The electrodes 9 and 10, moreover, are made durable by making at least their surface portions in the neighborhood of their approach to each other out of a material having relatively high resistance to sputtering erosion from the impact of gas ions.

The gas filling of the envelope 20 can, for example, be nitrogen or a nitrogen-argon mixture with a nitrogen-argon ratio from10:1 to 1:2, at a pressure which at normal room temperature ranges from about 1 to about 15 bars. In such gas fillings, any content of other noble gases or a hydrogen should be less than 10 percent by volume. The gas filling in the envelope 20 can also be a noble gas entirely, preferably argon, or a noble gas mixture, at a pressure in the range from about 1 to about 15 bars, and may in such case have a nitrogen or a hydrogen content of not more than 0.2 percent by volume.

Suitable materials out of which the electrodes 9 and 10 may be made are, for example, an iron-cobalt-nickel alloy and an iron-cobalt-chromium alloy. The choice of alloy may be determined by the requirements of the seal with the envelope.

The sputter resistant material for the exposed surfaces of the electrodes 9 and 10 can be zirconium, tantalum, hafnium, niobium, titanium, molybednum, tungsten, iron, cobalt, nickel or an alloy of two or more of these materials, in which case the main component of the gas filling of the envelope 20 should be a noble gas, preferably argon. The sputter resistant material can also be a nitride of zirconium, hafnium, niobium, vanadium or iron, preferably zirconium nitride, in which case the gas filling of the envelope 20 should contain nitrogen.

The potential at which an electric breakdown occurs when one of the auxiliary spark gap devices has its gap in its narrowed condition should be at most 80 percent of the potential at which the gap would break down when the gap is in its widest condition.

In the form of construction shown in FIG. 1, the electrode movement in the auxiliary spark gap devices is produced by the field of a permanent magnet, the magnet 14 being a permanent magnet mounted on a revolving shaft 24 driven by the engine at camshaft speed. The magnet 14 is mounted, as shown in FIG. 1, with its north pole directed toward the attraction body 15 of the auxiliary gap device 4 and after the shaft 24 revolves through 180°, it will move past the attraction body 15 of the auxiliary gap device 8 and a further rotation by 180° will cause it to pass again by the attraction body 15 of the auxiliary gap device 4. The magnet 14 is so mounted on its shaft that it has just produced the narrowing of the gap between the electrodes 9 and 10 in the auxiliary spark gap device 4 or in the auxiliary gap device 8, as the case may be, when the ignition voltage is generated in the secondary winding 7 of the spark coil 6, for example by interruption of a current previously caused to flow in the primary winding 25. The reduced interelectrode spacing at the selected auxiliary spark gap device 4 and 8 then assures the occurrence of an electric breakdown in response to the ignition voltage in the selected auxiliary spark gap and, consequently, also in the sparkplug connected thereto, without any substantial possibility that any leakage currents could interfere with this operation.

Of course, instead of the construction shown, the magnet 14 could be mounted in fixed position for example with its north pole opposite the attraction body 15 of the auxiliary spark gap device 4 and its south pole opposite the attraction body 15 of the auxiliary spark gap device 8 and an interposed magnetically shielding diaphragm (not shown in the diagram) rotating with the shaft body 4, could be arranged to revolve in such a way that it would release the magnetic field to influence the attraction body 15 of the selected auxiliary spark gap device at a time appropriate for igniting the sparkplug connected thereto. The magnet 14 could in such a case also be an electromagnet.

The attraction bodies of each of the auxiliary spark gap devices 4 and 8 could also each be associated with an electromagnet, not shown in the drawing, in which case the coils of the respective electromagnets could be supplied selectively with current in the manner described below with reference to FIG. 3.

Figure 2:
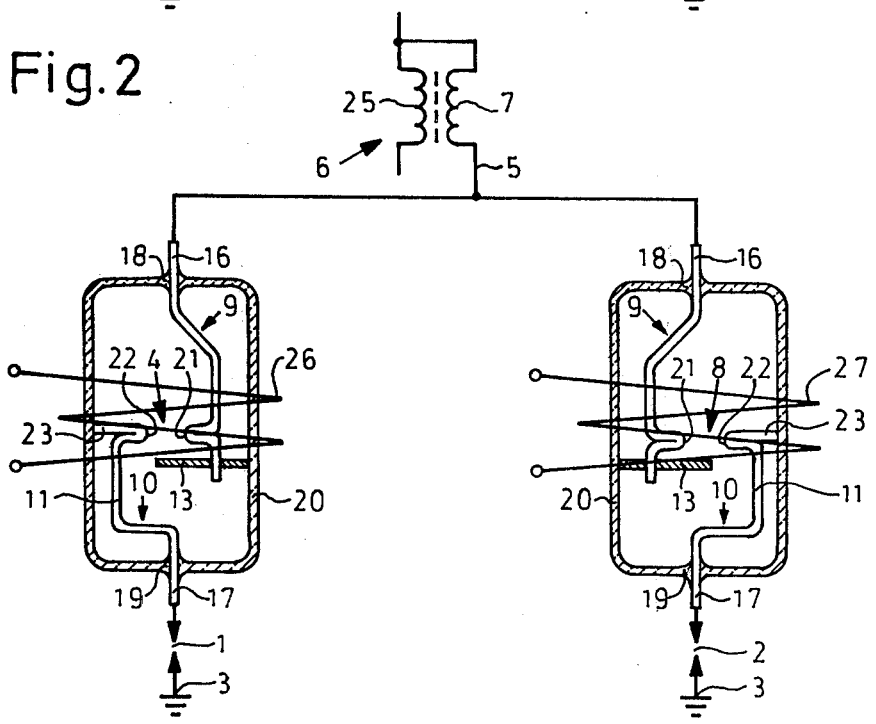
FIG. 2 is a diagram of an ignition system embodying the improvement of this invention in which the electrode spacing of each auxiliary spark device is subject to being narrowed by electromagnetic force.

In FIG. 2 the components operating in the same manner as in FIG. 1 are identified by the same reference numbers and are not again described in detail with reference to FIG. 2. The system shown in FIG. 2 utilizes electromagnetic force for producing electrode movement. The auxiliary spark gap devices 4 and 8 are in this case constructed after the manner of a reed relay, with an actuating coil surrounding the gas-filled envelope 20 which surrounds the operative portion of the electrodes. The auxiliary gap device 4 is provided with the actuating coil 26, while the auxiliary gap device 8 has the control coil 27, the coils in each case being coaxial with the general direction of electrode alignment. The electrode arrangement preferred for its suitability for this construction comprises electrodes 9 and 10 consisting essentially of magnetically conducting material and arranged in series in the magnetic circuit of the control coil, the interelectrode gap also being in series with the control coil. Accordingly, the provision of a special member like the attraction body 15 of FIG. 1 is not strictly necessary.

Figure 3:
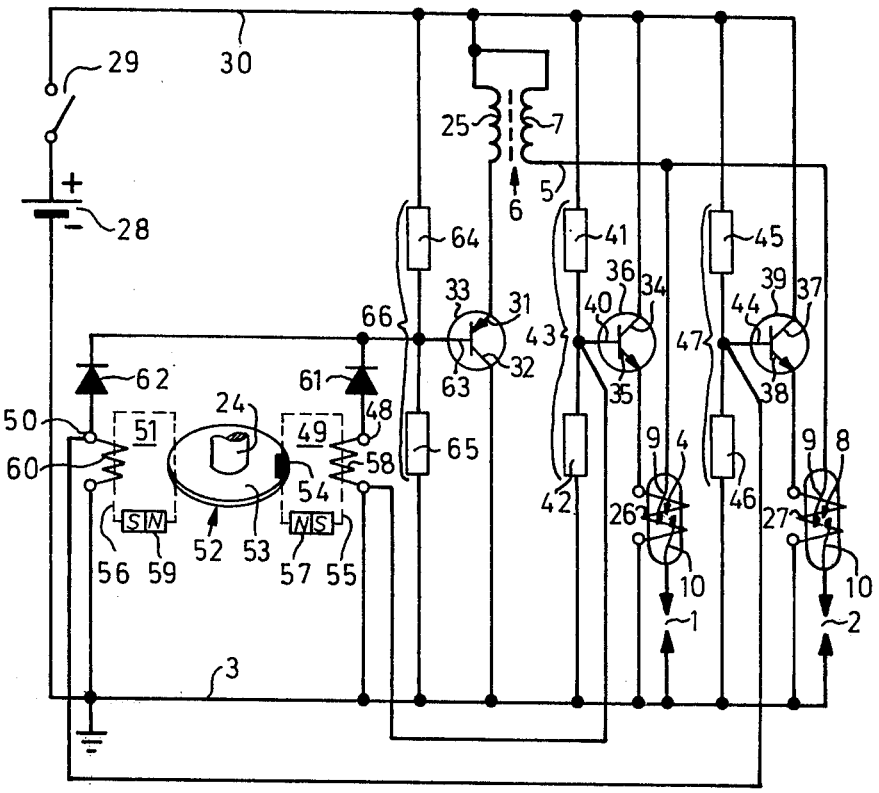
FIG. 3 is a circuit diagram of the complete circuit, including control circuit, of an ignition distribution system of the kind shown in FIG. 2.

FIG. 3 shows a circuit by which operating current can suitably be supplied to the control coils 26 and 27. This circuit diagram shows an ignition system for an engine not shown in the drawing that powers a motor vehicle likewise not shown. The ignition system is supplied with current from the source 28 that can, for example, be the battery of the vehicle. The current source 28 has a ground connection 3 at its negative pole, while its positive pole is connected through an ignition switch 29 to a power supply bus 30. The primary winding 25 of the ignition coil 6 is connected in series with the switching path extending from the emitter 31 to the collector 32 of the transistor 33 that constitutes a controllable electronic switch and this series combination is connected across the battery with the primary winding connected to the positive pole and the collector 32 of the transistor 33 grounded.

The secondary winding 7 of the ignition coil 6 is required to make ignition voltage available to the two sparkplugs 1 and 2. In order to distribute the ignition pulses successively to the sparkplugs 1 and 2, the auxiliary spark gap 4 is connected in series with the sparkplug 1 and the auxiliary spark gap 8 in series with the sparkplug 2.

The control coil 26, together with the switching path provided between the collector 34 and the emitter 35 of the transistor 36 that serves as an electrically controllable ignition switch, forms another series circuit, which is connected on the coil side to the ground connection 3 and at the collector 34 to the supply bus 30. Similarly, the coil 27 is in a series circuit with the switching path formed between the collector 37 and the emitter 38 of another transistor 39, also serving as an electrically controllable ignition switch, connected across the current supply with the coil side again grounded and with the collector 37 connected to the supply bus 30. The base electrode 40 of the transistor 36 is connected to the tap of a voltage divider 43 provided between battery and ground and consisting of the resistors 41 and 42. The base 44 of the transistor 39 is similarly connected to the tap of the similarly connected voltage divider 47 composed of the resistors 45 and 46. The base 40 of transistor 36 is also connected to the output terminal 48 of a signal transducer 49 and the base 44 of transistor 39 is likewise connected to the output terminal 50 of a signal transducer 51. The signal transducers 49 and 51 in the illustrated case are induction type transducers that are excited by a signal producing member 52 arranged for being revolved by the engine to cause the transducers 49 and 51 to produce alternately in sequence a control signal S (FIG. 4) that has, more or less, the wave shape of a sinusoidal half wave. The signal producer 52 is composed of a disk 53 of magnetically non-conducting material having in its peripheral zone a piece 54 of magnetically conducting material extending over a relatively small sector of the periphery of the disk 53. The disk 53 is affixed to the shaft 24 which turns at the cam shaft rate during operation of the engine. The excitation piece 54 passes through the magnetic circuit 55 of the signal transducer 49 indicated by a dashed line and then after a further rotation of 180°, passes through the similarly indicated magnetic circuit 56 of the signal transducer 51. The magnetic circuit 55, which is energized by the field of a permanent magnet 57, passes through a transducer coil 58 one terminal of which is connected to the ground connection 3, while the other is connected to the output terminal 48. The magnetic circuit 56 is similarly energized by the field of a permanent magnet 59 and passes through a transducer coil 60 that likewise has one terminal grounded and the other terminal connected to an output terminal 50. The output terminals 48 and 50 of the respective signal transducers are each connected through a blocking diode, respectively 61 and 62, to the base 63 of transistor 33. The polarity of the diodes 61 and 62 is such as to be in the conducting direction for the control signals S produced by the respective transducers 49 and 51. The base 63 of transistor 33 is, furthermore, connected to the tap of the voltage divider 66 connected across the battery and constituted by the resistors 64 and 65.

Figure 4:
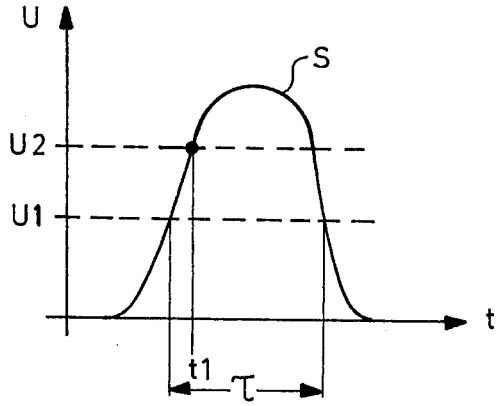
FIG. 4 is a graph for explaining the course of a control signal used in the ignition distribution system shown in FIG. 3.

The voltage divider 66 is so dimensioned, in comparison with the voltage dividers 43 and 47, that, as shown in the voltage (U)-time (t) diagram of FIG. 4, the switching threshold U1 at which the switching path 34–35 or the switching path 37–38 of transistor 36 or transistor 39, as the case may be, is made conducting by the control signal S is lower in voltage than the switching threshold U2 at which the switching path 31–32 of transistor 33 is put into the non-conducting condition. It is thus assured that the moment *t*1 of the switching over transistor 33 determining the beginning of the ignition operation will lie within the time period T during which one or the other of the switching paths 34–35 and 37–38 of the respective transistors 36 and 39 are in the conducting condition.

Of course, for generation of the control signal S, it is also possible to use a pulse shaping circuit and, if necessary, to arrange for an input thereto from a conventional interruptor switch.

The ignition circuit above described has the following manner of operation:

As soon as the ignition switch 29 is closed, the ignition circuit is ready for operation. If the exciter member 54 is outside of the magnetic circuits 55 and 56, the base 63 of transistor 33 is negatively biased with respect to the emitter 31 to such an extent by the voltage divider 66 that the switching path 31–32 is in its conducting condition. The primary winding 25 of the ignition coil 6, accordingly passes a current supplied by the current source 28.

The base 40 of the transistor 36 is negatively biased with respect to the emitter 35 by the voltage divider 43 to such an extent that the switching path 34–35 is in its non-conducting condition. Likewise, the base 44 of transistor 39 is negatively biased relative to the emitter 38 by the voltage divider 47 to such an extent that the switching path 37–38 is in its non-conducting condition.

If now the rotating disk 53 moves the exciting member 54 through an air gap, not specifically shown in the drawing, of the magnetic circuit 55, an alternating voltage period is produced of which the first half wave forms the control signal S shown in FIG. 4, i.e. this half wave is positive relative to the ground connection 3. When the control signal S then reaches the switching threshold U1, the base 40 of transistor 36, connected to the output terminal 48 of the transducer coil 58, is made sufficiently positive relative to the emitter 35 of the same transistor so that the switching path 34–35 becomes conducting. In consequence, the control coil 26 is supplied with current from the current source 28 and the resulting magnetic force reduces the spacing of the auxiliary spark gap 4 between the electrodes 9 and 10.

When the control signal S reaches the switching threshold U2, the base 63 of transistor 33 connected to the output terminal 48 of the transducer coil 58 through the blocking diode 61 becomes sufficiently positively biased relative to the emitter 31 of the same transistor, so that the switching path 31–32 is put into the current blocking condition. Consequently, the flow of current in the primary winding 25 of the ignition coil 6 is interrupted and, as a result, a high voltage kick is produced in the secondary winding 7. This high voltage pulse provides ignition voltage for the sparkplug 1 where it produces an electric breakdown (spark) to ignite the compressed fuel-air mixture in the corresponding cylinder.

The sparkplug 1 receives the ignition voltage in the case just described because the electrodes 9 and 10 of the auxiliary spark gap device 4 have a reduced spacing and, therefore, a lower electric breakdown voltage than that of the auxiliary spark gap device 8, the electrodes 9 and 10 of which at that moment have a relatively greater spacing.

As soon as the control signal S falls below the switching threshold U2, the switching path 31–32 of transistor 33 goes back to its conducting condition. When the control signal S falls below the switching threshold U1, the switching path 34–35 of transistor 36 becomes non-conducting and the current in the control coil 26 is again interrupted. The electrodes 9 and 10 of the auxiliary spark gap device 4, therefore, increase their spacing again to the original gap width.

When the rotating disk 53 moves the exciting member 54 through the air gap (not shown) of the magnetic circuit 56, a newly generated control signal S of the kind already described will be produced, this time in the transducer 51, and when the switching threshold U1 is exceeded the switching path 37–38 of transistor 39 will be put into the conducting condition and the control coil 27 accordingly switched on. The magnetic force of the control coil 27 reduces the spacing between the electrodes 9 and 10 of the auxiliary spark gap device 8. As soon as the control signal S reaches the switching threshold U2 and the then non-conducting switching path 31–32 of transistor 33 again starts an ignition pulse, the sparkplug 2 receives the resulting ignition voltage because of the relatively easier breakdown of the auxiliary spark gap 8. The compressed fuel-air mixture in the cylinder associated with the sparkplug 2 is then ignited.

As shown by the illustrative example just described, the ignition distribution system of the present invention makes use for the triggering of the ignition operation of a simple rotating signal initiator 52, but does not require a rotating member for actual distribution of the ignition voltage, which makes it possible to dispense with the conventional spark distributor or else to provide a drastic simplication of such a distributor.

Of course, instead of the electrically controllable ignition switches 36 and 39 mechanical switching devices can be provided, which will make sure that when the ignition voltage is generated one of the coils 26 and 27 will always be in circuit. Using as a starting point the conventional spark distributor described at the outset, such mechanical switching can be constituted so that on the free end face of the contact finger a sliding contact provided with spring pressure and preferably made of graphite can be installed and the fixed contacts over which the sliding contact is caused to pass can be formed by contact paths insulated from each other. The sliding contact thus always stands in contact with one of the contact paths when an ignition voltage pulse is produced. The aforesaid contact paths (not shown) will then be respectively connected to the control coils 26 and 27 and through them to the ground connection 3, while the sliding contact (likewise not shown) will be connected to the supply bus 30.

Finally, the auxiliary spark gap devices 4 and 8 and their control coils can as a matter of construction layout be arranged in any desired part of the system, thus for example in or on the ignition coil or in the sparkplug housings.

Thus, it will be understood that although the invention has been described with reference to particular illustrative embodiments, variations are possible within the inventive concept.

I claim:

1. In an ignition distribution system of the flashover distribution type for an internal combustion engine having a plurality of sparkplugs arranged to receive their ignition voltage selectively from a common source comprising the secondary of an ignition transformer, the improvement comprising:

an auxiliary spark gap device interposed in series between each sparkplug and said ignition transformer secondary and each having two electrodes (9 and 10) at least one of which is movable by magnetic force, and means for selectively moving the movable electrodes of the respective auxiliary spark gap devices by magnetic force in sequence in such a way that the gap (4,8) between the electrodes (9 and 10) of the auziliary spark gap device in series with the spark plug (1,2) that is to be ignited is narrowed but not thereby closed for a period including the moment of application of an ignition voltage pulse by said transformer secondary.

2. Improvement in an ignition distribution system as defined in claim 1 in which at least one of the two electrodes (9,10) of each of said auxiliary spark gap devices is provided with a resilient tongue portion (11) such that such electrode is caused by a magnetic force to approach the other electrode of the auxiliary spark gap device against the restoring force of said tongue.

3. Improvement in an ignition distribution system as defined in claim 1 in which means (13) are provided for limiting the extent of narrowing of the gap between the electrodes in each of said auxiliary spark gap devices.

4. Improvement in an ignition distribution system as defined in claim 1 in which both the electrodes (9 and 10) of each of said auxiliary spark gap devices consist at least predominantly of magnetically conducting material and are disposed in series in a magnetic circuit in which said magnetic force is generated.

5. Improvement in an ignition distribution system as defined in claim 1 in which said means for selectively moving the movable electrodes of the respective auxiliary spark gap devices by magnetic force includes a magnet (14) for generating said magnetic force and in which a magnetic attraction body (15) of ferromagnetic material is mounted on the movable electrode (10) of each auxiliary spark gap device, so as to be positioned between said movable electrode (10) and said magnet (14).

6. Improvement in an ingition distribution system as defined in claim 1 in which both electrodes (9 and 10) of each of said auxiliary spark gap devices are disposed so as to extend away from their neighboring free ends towards their respective points of affixation (18,19) in at least approximately oppositely directions.

7. Improvement in an ignition distribution system as defined in claim 1 in which the two electrodes (9 and 10) of each of said auxiliary spark gap devices overlap in spaced relation in the region of their free ends.

8. Improvement in an ignition distribution system as defined in claim 1 in which at least one of the two electrodes (9 and 10) of each of said auxiliary spark gap devices has an at least approximately nose-like projection (21,22) directed towards the other electrode.

9. Improvement in an ignition system as defined in claim 1 in which each of said auxiliary spark gap devices includes a hollow envelope body (20) of magnetically nonconducting material enclosing at least the region of its spark gap.

10. Improvement in an ignition distribution system as defined in claim 9 in which the respective envelopes (20) of said auxiliary spark gap devices are filled with an inert gas.

11. Improvement in an ignition distribution system as defined in claim 1 in which both electrodes (9 and 10) of each of said auxiliary spark gap devices are made, at least on their surfaces, in the region of their approach to each other, of a material resistant to disintergration by sputtering.

12. Improvement in an ignition distribution system as defined in claim 1 in which said means for selectively moving the movable electrodes of the respective auxiliary spark gap devices by magnetic force is so constituted as to expose said auxiliary spark gap devices successively in turn to a permanent-magnet force.

13. Improvement in an ignition distribution system as defined in claim 1 in which said means for selectively moving the movable electrodes of the respective auxiliary spark gap devices is so constituted as to expose said auxiliary spark gap devices successively in turn to the influence of an electromagnetic force.

14. Improvement in an ignition distribution system as defined in claim 13 in which each of said auxiliary spark gap devices is provided with a control coil (26,27) arranged to exert the magnetic force for moving at least one electrode of the particular device when said coil is energized with current.

15. Improvement in an ignition distribution system as defined in claim 14 in which each of said auxiliary spark gap devices is provided with a hollow envelope body (20) enclosing at least the region of its spark gap and in which said control coil for the auxiliary spark gap device surrounds said envelope body.

16. Improvement in an ignition distribution system as defined in claim 14 in which the respective control coils (26,27) of said auxiliary spark gap devices are successively connectable to a current source (28) and the timing of the connection of the respective control coils to said current source is timed in each case to include a single ignition operation.

17. Improvement in an ignition distribution system as defined in claim 16 in which each of the control coils of the respective auxiliary spark gap devices is connected in series with the switching path (34–35, 37–38), of one of a plurality of controllable ignition switches (36,39) and therethrough to said current source (28) and the switching over of each of said switching paths into the conducting condition is dependent in each case on the initiation of an ignition operation.

18. Improvement in an ignition distribution system as defined in claim 17 in which a plurality of pulse generating transducers (49,51) are provided and arranged so as to be activated in sequence by a rotary exciting device (52) driven by said engine, and thereby caused to produce an ignition operation initiating control signal (S) and in which each of said transducers (49,51) is also arranged to control at least one of said controllable ignition switches (36,39).

* * * * *